US005924142A

United States Patent [19]

Wang

[11] Patent Number: 5,924,142

[45] Date of Patent: Jul. 20, 1999

[54] AUTOMATIC DISPENSING SYSTEM

[75] Inventor: Kenneth Wang, 3856 Udell Ct., Los Angeles, Calif. 90027

[73] Assignee: Kenneth Wang, Los Angeles, Calif.

[21] Appl. No.: 08/915,369

[22] Filed: Aug. 20, 1997

[51] Int. Cl.[6] ..... E03D 9/02

[52] U.S. Cl. ..... 4/227.2; 4/227.3; 4/222

[58] Field of Search ..... 4/227.2, 227.3, 4/227.4, 222, 223, 224, 225.1

[56] References Cited

U.S. PATENT DOCUMENTS

| | | | |
|---|---|---|---|
| 4,429,809 | 2/1984 | Bousgarbies | 4/227.1 |
| 4,656,676 | 4/1987 | Dufau et al. | 4/228 |
| 5,152,015 | 10/1992 | Fourman | 4/225.1 |
| 5,488,742 | 2/1996 | Liao | 4/227.3 |
| 5,603,126 | 2/1997 | Scoggins | 4/225.1 |

*Primary Examiner*—David J. Walczak
*Attorney, Agent, or Firm*—Christensen O'Connor Johnson Kindness PLLC

[57] ABSTRACT

An automatic dispensing system dispenses chemical directly into a toilet bowl after the toilet bowl is flushed and includes a chemical dispenser and a hydraulic actuator. The chemical dispenser includes a pumping unit attached to a storage unit for storing a chemical cleaning and/or disinfecting solution. The chemical dispenser is attached to the hydraulic actuator, which is in turn attached to the overflow pipe in the tank of the toilet. The hydraulic actuator is also connected to a toilet bowl refill hose. During the flushing process, pressurized water controlled by a water level control unit is used to refill the toilet tank. Some of this water is shunted to the hydraulic actuator assembly. In response to the flow of pressurized water, the hydraulic actuator actuates the pumping unit to measure out a predetermined amount of chemical. When the toilet tank is refilled, the flow of pressurized water is stopped. In response to the stoppage of the pressurized water, the hydraulic actuator assembly causes the pumping unit to inject the measured out chemical directly into the toilet bowl through the toilet bowl refill hose.

22 Claims, 8 Drawing Sheets

AUTOMATIC DISPENSING SYSTEM

FIELD OF THE INVENTION

The present invention relates to chemical dispensing systems, more particularly, to automatic chemical dispensing systems for toilets.

BACKGROUND

Typical conventional chemical dispensing systems use dry chemical tablets. These dry tablets are generally placed in the toilet tank and are composed so that the dry tablets slowly dissolve in the tank water, releasing a cleaning or disinfectant agent. The cleaning agent is then released into the toilet bowl when the toilet is flushed.

In a later refinement, a housing was added to the dispenser. This semi-enclosed housing held the dry chemical tablet and was attached on the side of inner surface of the toilet tank, placing the dry tablet in the tank water. This housing served to slow down the release of the chemical.

More recently, devices with a pressurized secondary tank were developed to replace the reservoir of water in the water tank that is used to flush the toilet. These devices are installed within the water tank and may contain chemical cleaners or disinfectants. These devices use the pressurized secondary tank to dispense water and chemicals into the toilet bowl to flush and clean the toilet bowl.

These types of conventional systems have several disadvantages. For example, in the dry tablet systems, as the dry chemical dissolves, the surface area of the tablet is reduced. Further, the rate at which the chemical dissolves into the tank water is related to the surface area of the tablet. Therefore, as the tablet size is reduced, for a given time period the concentration of the chemical in the tank water diminishes. Further, the time between flushes is also related to the concentration of the chemical in the treated tank water. For example, if the toilet is unused for several days, the chemical concentration of the tank water tends to significantly increase. It is possible that an entire tablet can be dissolved and be used in a single flush. Thus, the amount of chemical dispensed into the toilet bowl is not consistent, which tends to both decrease the effectiveness of the cleaning/disinfecting process and waste the chemical.

Moreover, because the chemical is dissolved into the tank water (which is mainly used to flush the toilet), most of the chemical is wasted in that the chemical is merely flushed away rather than being retained in the toilet bowl where the chemical can effectively clean and/or disinfect the toilet bowl. This deficiency also applies to the pressurized secondary tank systems with added(s). More specifically, the flushing process uses roughly two thirds of the treated solution to flush the contents of the toilet bowl into the sewage system. Thus, only a residual amount of the chemically treated water is left to serve as the standing water in the toilet bowl. In addition, the pressurized secondary tank systems tend to be complex and costly.

Accordingly, there is a need for a simple, low cost, efficient dispensing system for a toilet that provides a predetermined amount of chemical into the toilet bowl without wasting chemical in the flushing process.

SUMMARY

In accordance with the present invention, an automatic dispensing system is provided for dispensing an agent directly into a toilet bowl after the toilet bowl is flushed. In one embodiment for use with an existing conventional toilet flushing apparatus, the automatic dispensing system includes a chemical dispenser and a hydraulic actuator assembly. The chemical dispenser includes a pumping unit attached to a storage unit (e.g. collapsible bag or a refillable container) for storing a chemical cleaning and/or disinfecting solution. The chemical dispenser attached to the hydraulic actuator assembly, which is in turn attached to the overflow pipe in the tank of the toilet. The hydraulic actuator is also connected to the toilet bowl refill hose of the existing toilet flushing apparatus.

During the flushing process, water stored in the toilet tank is released into the toilet bowl to flush the contents of the toilet bowl into the sewage system. After the toilet tank is substantially emptied, pressurized water controlled by the existing water level control apparatus of a typical conventional toilet flushing apparatus is used to refill the toilet tank. In addition, some of the pressurized water is shunted into the existing overflow pipe via the refill hose to refill the toilet bowl.

In accordance with this embodiment of the present invention, the shunted pressurized water is used by the hydraulic actuator assembly to move a piston in the hydraulic actuator assembly, which in turn moves a plunger and a valve structure in the pumping unit. The movement of the valve structure exposes holes in the plunger, with the holes communicating between the storage unit and a cavity in a housing containing the valve structure and the plunger. In addition, the movement of the valve structure closes a hole communicating between the overflow pipe and the cavity. The movement of the plunger within the housing increases the volume of the cavity, creating a vacuum in the cavity to draw a portion of the chemical solution stored in the storage unit into the housing cavity. With the plunger fully extended by the piston, the housing cavity holds a volume of chemical solution predetermined to effectively clean and/or disinfect the toilet bowl.

When the toilet tank is refilled, the existing water level control apparatus interrupts the flow of pressurized water to the toilet tank and toilet bowl, thereby removing the force on the piston in the hydraulic actuator assembly. A spring in the pumping unit then moves the piston back towards its original position, causing the valve structure and the plunger to move back to their original positions. More specifically, the valve structure covers the holes in the plunger, preventing backflow of chemical solution into the storage unit. In addition, this movement of the valve structure back to the valve structure's original position in the housing also uncovers the holes communicating with the existing overflow pipe. The movement of the plunger reduces the volume of the cavity, causing the measured portion of chemical solution in the cavity to be injected into the overflow pipe (and thus into the toilet bowl).

Thus, unlike the aforementioned conventional systems, a predetermined amount of the chemical solution is injected into the toilet bowl after the flushing process is substantially completed. Therefore, a precise, consistent amount of chemical is provided directly into the toilet bowl at a predetermined time during the toilet bowl refill process (and not during the toilet bowl flush process) so that the chemical remains in the toilet bowl until a subsequent flush of the toilet. Consequently, the amount of chemical needed to clean/disinfect the toilet bowl is reduced, while the tank water is kept free of the chemical(s).

In another embodiment, the chemical dispenser is adapted to dispense solid chemical spheres instead of a solution. More specifically, the movement of the piston in the hydraulic actuator assembly exposes a drop hole through which the solid chemical sphere is dropped into the overflow pipe.

In still another embodiment, the automatic dispensing system is adapted for use with tankless toilets and urinals, which use pressurized water to flush the toilet (or urinal) controlled by a valve. This embodiment is substantially similar to the first embodiment described above, except that the system is attached to the valve of the tankless unit instead of a overflow pipe. This embodiment shunts a portion of the pressurized water released by the valve during a flush to operate a hydraulic actuator to measure out a portion of chemical solution in the cavity of the pumper unit, as previously described. When the tankless unit shuts off the flow of pressurized water, the hydraulic actuator causes the pumper unit to dispense the chemical solution into the toilet bowl or urinal in a manner similar to the previously described first embodiment.

In yet another embodiment, the automatic dispensing system includes a chemical dispenser and a level control valve assembly with integrated hydraulic actuator. This embodiment is used as a replacement for an existing conventional level control apparatus in the toilet tank.

The level control valve assembly also includes a buoy lever mechanism connected to a dual piston assembly of the hydraulic actuator. The bottom of the dual piston assembly is attached to the water inlet pipe (which is used to provide pressurized water to refill the toilet tank and the toilet bowl) of the toilet tank. The dual piston assembly includes an outer piston with a set of outer holes and a set of inner holes on the piston plate. The inner piston is coaxial with the outer piston (i.e., with the piston rod of the inner piston fitted within the hollow piston rod of the outer piston). The inner piston has a piston plate sized to cover the inner holes but not the outer holes of the outer piston when the inner piston plate is pressed against the outer piston plate.

After the toilet is flushed, the water level in the toilet tank decreases. As a result, the buoy drops removing the downward force on the lever mechanism to allow the dual pistons to move upward. The upward movement of the pistons uncovers an inlet hole in the piston housing, allowing pressurized water from the toilet tank's inlet pipe to enter the piston housing below the piston plates of the dual pistons. The hydraulic pressure provided by the entering pressurized water helps move the dual pistons upward and to press the inner piston plate upward against the outer piston plate, thereby sealing the set of inner holes in the outer piston plate. Pressurized water moves through the set of outer holes in the outer piston into the upper chamber of the piston housing and through a refill outlet and into the toilet tank.

The upward movement of the pistons also moves a plunger in a pumper unit of the chemical dispenser, in a manner similar to the chemical dispenser of the previously described first embodiment. Thus, the chemical dispenser measures out a precise amount of chemical solution to be injected into the toilet bowl.

After the toilet is flushed, the toilet tank is refilled. As the water level in the toilet tank increases, the buoy rises, causing the downward force to be applied to the inner piston of the dual piston assembly through the level mechanism. This downward force eventually overcomes the hydraulic force keeping the inner piston pressed against the outer piston, thereby exposing the set of inner holes on the outer piston plate. The additional holes allows more water to enter the upper piston chamber, reducing the upward force on the outer piston. With the additional force of a spring, the inner and outer pistons are moved downwards, covering the inlet hole in the piston housing (terminating the refill of the toilet tank) and allowing the plunger in the pumping unit to inject the measured amount of chemical solution into a refill output communicating with the overflow pipe. As a result, a precise amount of chemical solution is injected directly into the toilet bowl, timed so that the chemical solution is not provided until the current flushing process is completed.

DETAILED DESCRIPTION

Figure 1:
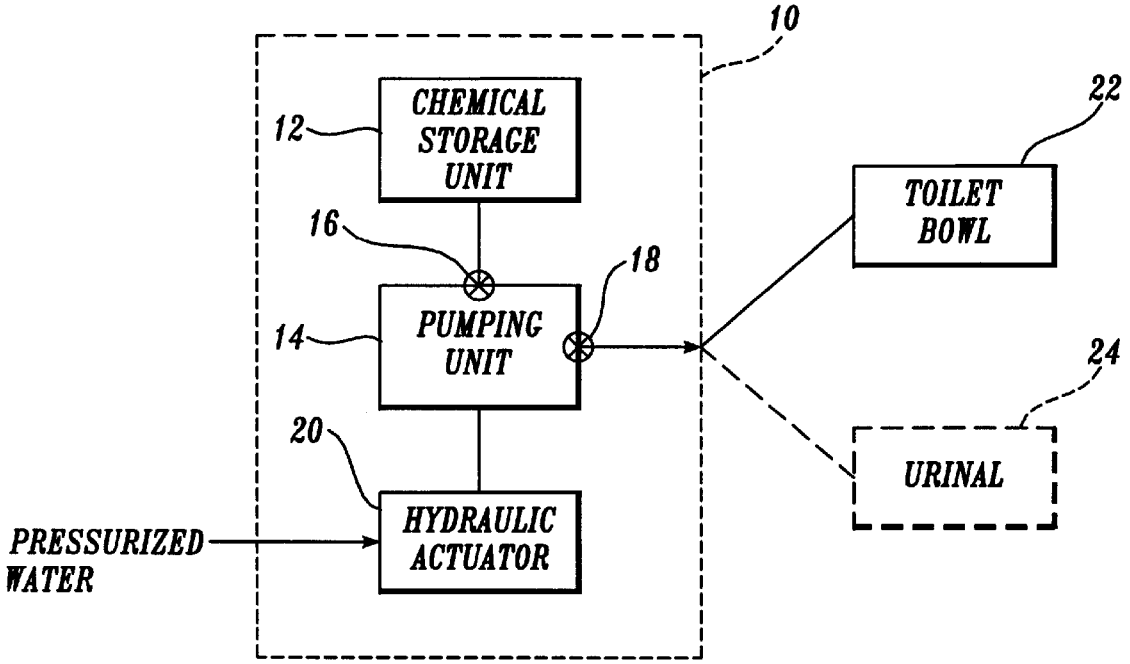
FIG. 1 is a functional block diagram of an automatic dispensing system according to one embodiment of the present invention.

FIG. 1 is a functional block diagram of an automatic dispenser system 10 for cleaning and/or disinfecting a toilet bowl, according to one embodiment of the present invention. The automatic dispenser system 10 includes a chemical storage unit 12, a pumping unit 14 and a hydraulic actuator assembly 20.

The chemical storage unit 12 stores a chemical solution or solid that is used to clean and/or disinfect the toilet bowl 22 or, optionally, urinal 24. For example, the chemical storage unit 12 may store a solution of sodium hyper chloride (e.g., bleach). In other embodiments, the storage unit 12 may be adapted to store solid chemical agents. For example, the storage unit 12 may be a type of trap that holds spheres of soluble disinfectant.

The pumping unit 14 is connected to the chemical storage unit 12 and is used to measure out a precise amount of chemical. In the embodiments using solid chemical spheres, the pumping unit 14 can be configured to measure out one sphere to be provided to the toilet bowl 22. In embodiments using chemical solutions, the pumping unit 14 can be configured to measure out a predetermined volume of chemical solution to be provided to the toilet bowl or urinal.

In one particular embodiment, when actuated, the pumping unit 14 is configured to perform a measuring operation during which the pumping unit 14 opens a first valve 16 communicating with the chemical storage unit 12 and closes a second valve 18 communicating with the toilet's overflow pipe (not shown). The pumping unit 14 then fills a chamber (not shown) with solution drawn from the chemical storage unit 12. The chamber is sized to contain a predetermnined or measured amount of chemical solution. Then when actuated a second time, the pumping unit 14 is configured to perform an injection operation during which the pumping unit 14 closes the first valve 16, opens the second valve 18, and injects the measured portion of chemical solution into the overflow pipe (not shown). The hydraulic actuator 20 is connected to the pumping unit 14 and is configured to actuate the pumping unit 14 at predetermined times after the toilet is flushed. When the toilet is flushed, the hydraulic actuator is configured to actuate the pumping unit 14 to perform the measuring operation. In this embodiment, the hydraulic actuator 20 uses the pressurized "refill" water provided by standard toilets after a flush to refill the toilet tank and toilet bowl to actuate the pumping unit 14 into the measuring operation. Thus, the measuring operation is timed to occur at about the same time a flush occurs. Then, when the flow of pressurized water is cut off (e.g., when the toilet tank is full), the hydraulic actuator 20 performs a second actuation to cause the pumping unit 14 to perform the injection operation. Accordingly, the injection operation is timed to occur at about the same time the flushing operation ends. As a result, the chemical solution is injected into standing water in the toilet bowl, unlike conventional systems in which the chemical is provided to the toilet bowl during the flushing process, where much of the chemical is merely flushed away into the sewage system without cleaning or disinfecting the toilet bowl.

Figure 2:
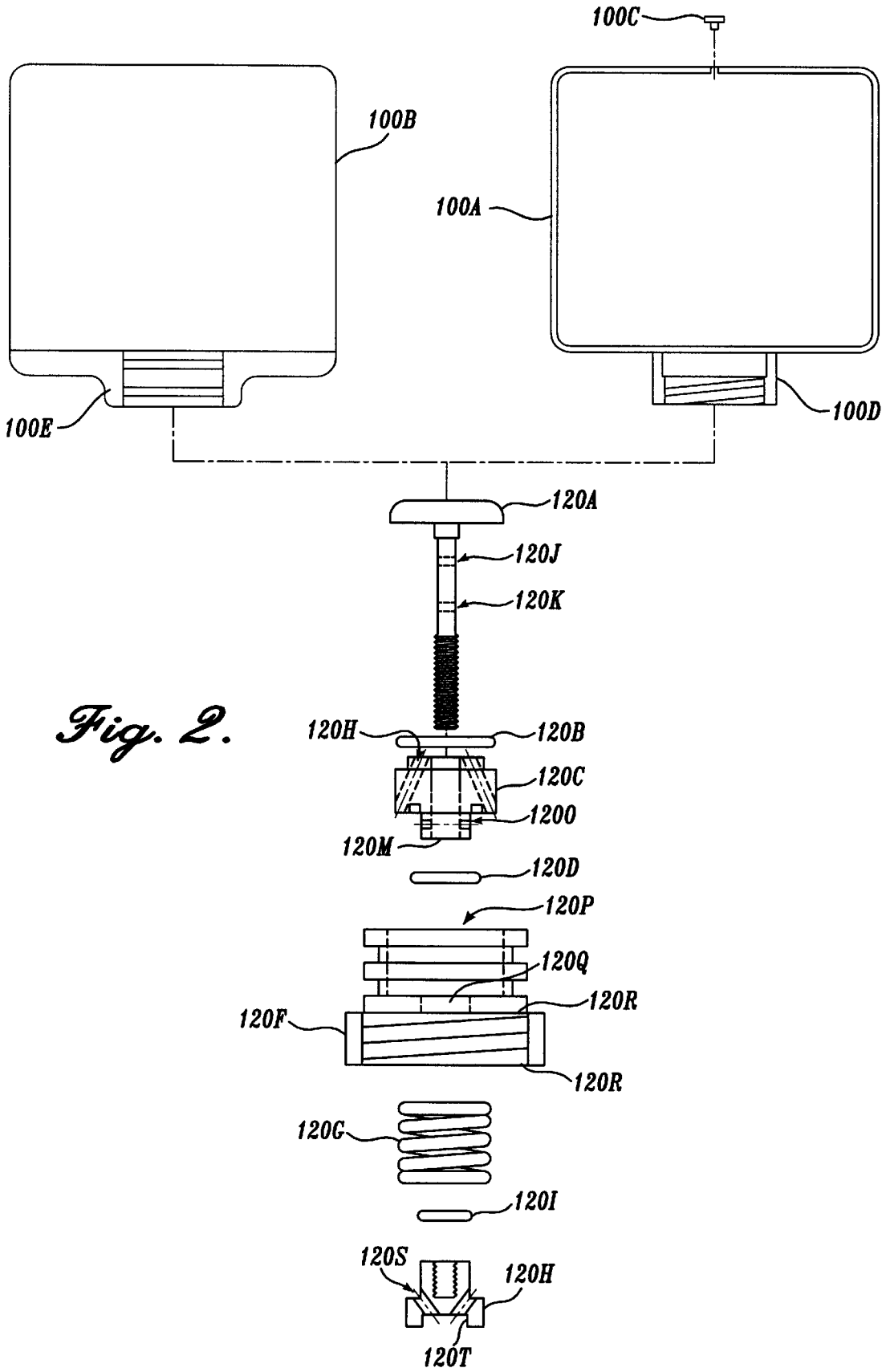
FIG. 2 is an exploded view diagram illustrative of a storage unit with pumping unit, according to two embodiments of the present invention.

FIG. 2 is an exploded view diagram illustrative of a storage unit 100*a*, a storage unit 100*b* and a pumping unit 120. The storage unit 100*a* is a rigid container that can be reused by refilling the storage unit 100*a* with a desired solution through a removable plug or cap 100*c*. In this embodiment, the storage unit 100*a* is attached so that the pumping unit 120 is fitted into storage unit 100*a* through a threaded opening 100*d*.

FIG. 2 also shows a storage unit 100*b*, which is non-rigid (i.e., collapsible) and intended to be disposable. For example, the storage unit 100*b* can be a plastic bag with a base 100*e* with a grooved opening configured to hold the pumping unit 120. The base 100*e* may be rigid or flexible, as long as base 100*e* adequately supports the grooved opening. In these embodiments, the storage units 100*b* and 100*a* are roughly 60 mm (diameter) ×60 mm (height), which is large enough to store an amount of ten percent sodium hyper chloride solution for about five hundred to six hundred toilet bowl treatments. The storage units 100*a* and 100*b* are made from any suitable material that is compatible with the chemical solution. For example, parts that are directly contact with a sodium hyper chloride solution, can be made from Telflon®, Vilton® and other similar materials.

One embodiment of the pumping unit 120 includes a pump housing 120*f* that is roughly cylindrical, with two grooves at one end. These two grooves are configured to mate with the base 100*e* of the storage unit 100*b*. The pump housing 120*f* has an internal thread at the opposite end for mating with a hydraulic actuator (described below in conjunction with FIGS. 3–8). In another embodiment of the pumping unit 120 for use with the rigid storage unit 100*a*, a pump housing 120*e* is used instead of the pump housing 120*f*. The pump housing 120*e* is also cylindrical, but does not have the grooves and internal threading at the ends.

In both of these embodiments, the pump housings have a cylindrically-shaped pump cavity 120*p* that is roughly 12 mm (diameter) ×8 mm (height), with the open end of the cavity 120*p* communicating with the storage unit when the storage unit 100*a* (or 100*b*) is fitted onto the pumping unit 120. The cavity 120*p* is advantageously used to measure out an volume of the solution sufficient to treat a typical toilet bowl.

The pumping unit 120 includes a valve structure 120*a* and a plunger 120*c*. The valve structure 120*a* has a roughly disk shape portion and a partially hollow stem or shaft portion attached at approximately the center of the disk portion. The shaft or stem portion of the valve structure 120*a* is fitted into a central longitudinal hole 120*m* in the plunger 120*c*. A valve structure 'O' ring 120*b* is fitted between the valve structure 120*a* and the plunger 120*c*. The valve structure 120*a* also has a pair of grooves on the shaft portion, each having a hole (i.e., holes 120*j* and 120*k*) roughly along a diameter of the shaft portion and communicating with the central hole in the shaft portion. The grooves are approximately 1.5 mm (width) ×0.2 mm (depth). The top hole 120*j* (i.e., in the groove nearest the disk portion of the valve structure 120*a*) has a diameter of about 1.3 mm. The center of the top hole 120*j* and the top groove are about 10 mm below the top surface of the disk portion of the valve structure 120*a*.

The bottom hole 120*k* (i.e., in the other groove in the shaft portion of the valve structure 120*a*) is located roughly 16 mm below the top surface of the disk portion of the valve structure 120*a*. The distal end of the stem portion of the valve structure 120*a* is threaded. The stem portion of the valve structure 120*a* is hollow from the top groove down to the distal end. The overall dimensions of the valve structure 120*a* are roughly 25 mm (length) ×13 mm (disk portion diameter) ×4 mm (stem diameter).

The plunger 120*c* is roughly cylindrical in shape with the hole 120*m* along the longitudinal axis of the plunger 120*c*. The outer diameter of the plunger 120*c* is sized so that the plunger 120*c* can be fitted into the cavity 120*p* of the pump housing (either pump housing 120*f* or 120*e*). More specifically, the plunger 120*c* is relatively loosely fitted within the cavity 120*p* so that the plunger 120*c* can slide longitudinally within the cavity 120*p*. In this embodiment, the overall dimensions of the plunger 120*c* are roughly 13 mm (outer diameter) ×4 mm (inner diameter). The plunger 120*c* has a stem portion extending from the bottom groove, having dimensions of about 10 mm (length) ×5.5 mm (outer diameter). The stem portion of the plunger 120*c* extends through a hole 120*q* in a wall 120*r* in the pump housing 120*e* (and 120*f*). Except for the hole 120*q*, the wall 120*r* seals off part of the cylindrical pump housing 120*e* (or 120*f*) to define part of the cavity 120*p*. In this embodiment, the wall 120*r* is roughly perpendicular to the longitudinal axis of the pump housing 120*e* (or 120*f*).

The plunger 120*c* also has a groove at each end for receiving an 'O' ring. The retainer valve 'O' ring 120*b* has dimensions of roughly 10 mm (outer diameter) ×2 mm (thickness) and is fitted onto the top groove (i.e., the groove nearest the end of the plunger facing the storage unit 100*a* (or 100*b*). A plunger 'O' ring 120*d* is fitted on the bottom groove (i.e., the end of the plunger 120*c* facing the pump housing 120*e* (or 120*f*) and has dimensions of roughly 8 mm (outer diameter) ×2 mm (thickness).

The 'O' rings 120*b* and 120*d* are not intended to seal the contact between the sidewalls of the plunger 120*c* and the inner sidewalls of the cavity 120*p*. Instead, the 'O' rings 120*b* and 120*d* provide a tight seal to prevent leakage of chemical solution out of the cavity 120*p* when the plunger 120*c* is in a fully upward position (i.e, at about the end of the measuring operation). The plunger 120*c* is relatively loosely fitted in the cavity 120*p* with respect to the side clearance to allow for any expansion of the plunger 120*c* and for any deposits of the chemical on the inner surface of the cavity 120*p* and/or the sides of the plunger 120*c*. Although some leakage of solution may occur, the amount of leakage is negligible in view of the relatively larger openings (described below) for solution flow provided by the valve structure implemented by the valve structure 120*a* and the plunger 120*c*.

This embodiment of the plunger 120*c* has six diagonal holes 120*n* through the top surface of the plunger above the top groove. The six holes 120*n* extend at an angle downwards, terminating at the outer edge of the plunger 120*c*, slightly above the bottom groove on the plunger 120*c*. The six holes 120*n* are approximately 1.3 mm in diameter, thereby providing relatively large openings (compared to the 0.3 mm clearance between the plunger 120*c* and the inner surface of the cavity 120*p*) for flow of the chemical solution through the plunger 120*c*. When the valve structure 120*a* is fully extended by the hydraulic actuator (described below in conjunction with FIGS. 3–8), the holes 120*j* in the valve structure 120*a* are misaligned with the inlet hole 120*o* of the plunger 120*c*. In addition, the hole 120*k* is inside the central longitudinal hole 120*m* of the plunger 120*c* and sealed by the 'O' ring 120*i*. Thus, solution cannot flow through the valve structure 120*a*.

However, the six holes 120*n* in the plunger 120*c* are exposed when the valve structure 120*a* is extended, providing six passages between the storage unit 100*a* (or 100*b*) and the cavity 120*p* of the pump housing 120*e* (or 120*f*). Then when the plunger 120*c* is extended along with the valve structure 120*a* (described below in conjunction with FIGS. 3–8), a portion of the chemical solution is drawn from the storage unit 100*a* (or 100*b*) into the cavity 120*p*.

This two-step process used to measure out a portion of the chemical solution (i.e., firstly exposing the six holes 120*n*, and secondly moving the plunger 120*c* to draw chemical solution into the cavity 120*p*) precisely and reliably measures out the desired portion of solution. This two-step process avoids reliability problems caused by swelling of the material composing the various parts (e.g., the plunger 120*c* or the pump housing 120*e* or 120*f*) that may arise in a "positive seal" method that requires a "soft" material for the contact between the plunger 120*c* and the inner surface of the cavity 120*p* to achieve the positive seal for the plunger 120*c* in the cavity 120*p*.

The pump unit 120 also includes a return spring 120*g* fitted between the pump housing 120*e* (or 120*f*) and a retainer 120*h*. The return spring 120*g* has dimensions of roughly 9 mm (outer diameter) ×7.5 mm (inner diameter) ×25 mm (free length). The return spring 120*g* is used to provide a relatively small force to return the valve structure 120*a* and the plunger 120*c* to their original positions once the hydraulic actuator (described below in conjunction with FIG. 3) stops providing a force to extend the valve structure 120*a* and the plunger 120*c*. The return spring 120*g* also provides a residual force on the 'O' rings 120*e* and 120*d* to seal the cavity 120*p* and prevent leakage of the chemical solution.

A retainer 'O' ring 120*i* is placed between the pump housing 120*e* (or 120*f*) and the retainer 120*h* to seal the chemical solution in place when the plunger 120*c* is fully extended upwards. The 'O' ring dimensions are roughly 7 mm (outer diameter) ×3.5 mm (inner diameter) ×2 mm (thick). The retainer 120*h* is threaded on one end to mate to the stem portion of the valve structure 120*a*. The other end of the retainer 120*h* has shoulders 120*t* with two diagonal holes 120*s*. The retainer 120*h* has dimensions of roughly 7 mm (threaded end) ×13 mm (shoulder end) ×11 mm (height). The diagonal holes 120*s* are angled at roughly forty-five degrees from the longitudinal axis of the retainer 120*h*, with a diameter of about 1.5 mn. The diagonal holes 120*s* provide passages for the chemical solution ejected from the cavity 120*p*.

The retainer 120*h* of the pumping unit 120 is also fitted into a cavity (not shown) of the hydraulic actuator assemblies described below in conjunction with FIGS. 3–8).

Figure 3:
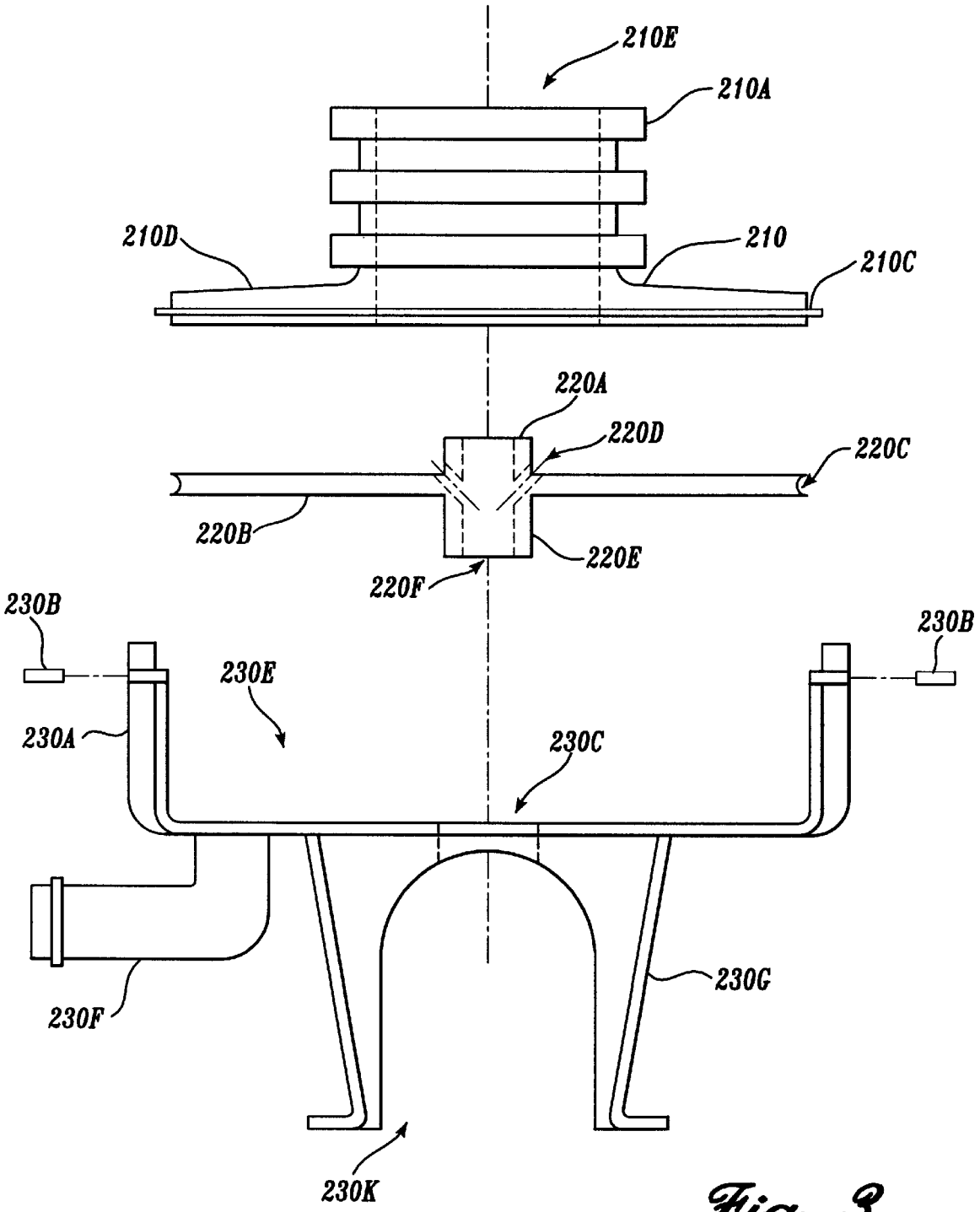
FIG. 3 is an exploded view diagram illustrative of a hydraulic actuator assembly, according to one embodiment of the present invention.

FIG. 3 is an exploded cross-sectional diagram illustrative of a hydraulic actuator assembly 200, according to one embodiment of the present invention. This embodiment is adapted for use with an attachment-type automatic dispensing system, as described in conjunction with FIGS. 4 and 5. This embodiment of the hydraulic actuator assembly 200 includes a cover 210, a hydraulic piston 220 and a base 230.

The cover 210 has a threaded portion 210*a* for mating with the threaded end of the pump housing 120*f* (FIG. 2). The threaded portion 210 is roughly 9 mm in length and screws into the pump housing 120*f*. The cover 210 also has cap 210*c* attached to the threaded portion 210*a*. The dimensions of the cap 210*c* are roughly 49 mm (inner diameter) ×1 mm (height). The cap 210*c* has three approximately horizontal stiffeners or ribs 210*d* that are about 6 mm (width) ×5 mm (height). The cover 210 also has a hole 210*e* through the center of the threaded portion 210*a* and the cap 210*c*. The hole 210*e* has dimensions of roughly 10.5 mm (diameter) ×15 mm (depth).

The hydraulic piston 220 includes a cylindrically-shaped neck 220*a*, a piston disk 220*b* and a cylindrically-shaped piston stem 220*e*. The piston neck 220*a* is attached to the top surface of the piston disk 220*b*, with the longitudinal axis of the piston neck 220*a* aligned with the center of the piston disk 220*b*. Similarly, the piston stem 220*e* is attached to the bottom surface of the piston disk 220*b*, with the longitudinal axis aligned with the center of the piston disk 220*b*. The piston neck 220*a* is about 8 mm (diameter) ×5 mm (length), whereas the piston stem 220*e* is about 8 mm (diameter) ×8.5 mm (length). The piston disk 220*b* is roughly 48 mm (diameter) ×3 mm (height), and has a groove 220*c* with a depth of about 2.5 mm along its circumference. In addition, a central hole 220*f* is located through the longitudinal axis of the piston neck 220*a* and piston stem 220*e*, and through the center of the piston disk 220*b*.

The hydraulic piston 220 has four pressure relief holes 220*d* at an approximately forty-five degree angle to the surface of the piston disk 220*b*, communicating with the central hole 220*f*. The holes 220*d* are roughly 2 mm (diameter) ×4 mm (length). The hydraulic piston 220 is closely fitted into the base 230, with the disk stem 220*e* fitted through a hole 230*c* in the bottom of the base 230.

The base 230 has a shape similar to a relatively shallow cylindrical cup. On the outer sidewalls of the base 230 there are three vertical stiffener segments 230*a* that are located to match the horizontal stiffeners 210*d* on the cover 210. The stiffener segments 230*a* are roughly 22 mm (height) ×6 mm (width) ×4 mm (depth). The base 230 also includes three lock pins 230*b* to fasten the stiffener segments 230*a* on the base 230 to the stiffeners 210*d* on the cover 210, thereby securely attaching the cover 210 to the base 230. The lock pins are roughly 1.5 mm (diameter) ×6 mm (length).

The base 230 forms a roughly cylindrically-shaped cavity 230*e*, with dimensions of about 49 mm (diameter) ×12 mm (height). Thus, the hydraulic piston 220 can be relatively tightly yet slidably fitted within the cavity 230*e*. The base 230 also has an angled water hose connection 230*f* at the bottom of the base. The angled hose connection communicates with the cavity 230*e* and is connected to a flexible hose (not shown) so as to receive pressurized water for filling the toilet bowl. As previously described, the flexible hose is part of the existing level control valve unit (not shown), and provides water to the overflow pipe (not shown) to fill the toilet bowl. After the toilet is flushed, the existing level control valve unit provides pressurized water to the angled hose connection 230*b*, thereby filling the cavity 230*e* and forcing the hydraulic piston 220 to move upwards. Because a hydraulic piston is used, the hydraulic force is "amplified" (i.e., the force is roughly equal to the water pressure times the surface area of the piston disk 220), resulting in a relatively large upward force on the piston disk 220. Accordingly, a more than sufficient force is provided to move the piston disk 220 against the return spring 120*g* and displace the valve structure 120*a* and plunger 120*c* in the measuring operation (see FIG. 2).

The base 230 also has a circular pipe clamp 230*g* attached to the bottom surface of the base 230 to couple the base to the overflow pipe (not shown). In particular, the pipe clamp 230*g* has three segments formed by three slots 230*h* equally spaced between the segments. The slots are roughly 22 mm (length) ×13 mm (width). The clamp 230*g* is sized to be slightly larger than the interior diameter of the overflow pipe, and is made from a relatively flexible material so that the clamp 230*g* can be pressed into the overflow pipe. Because the clamp 230 is slightly larger that the overflow pipe, the clamp 230 tightly presses against the inner surface of the overflow pipe, thereby clamping the base 230 the overflow pipe.

Figure 4:
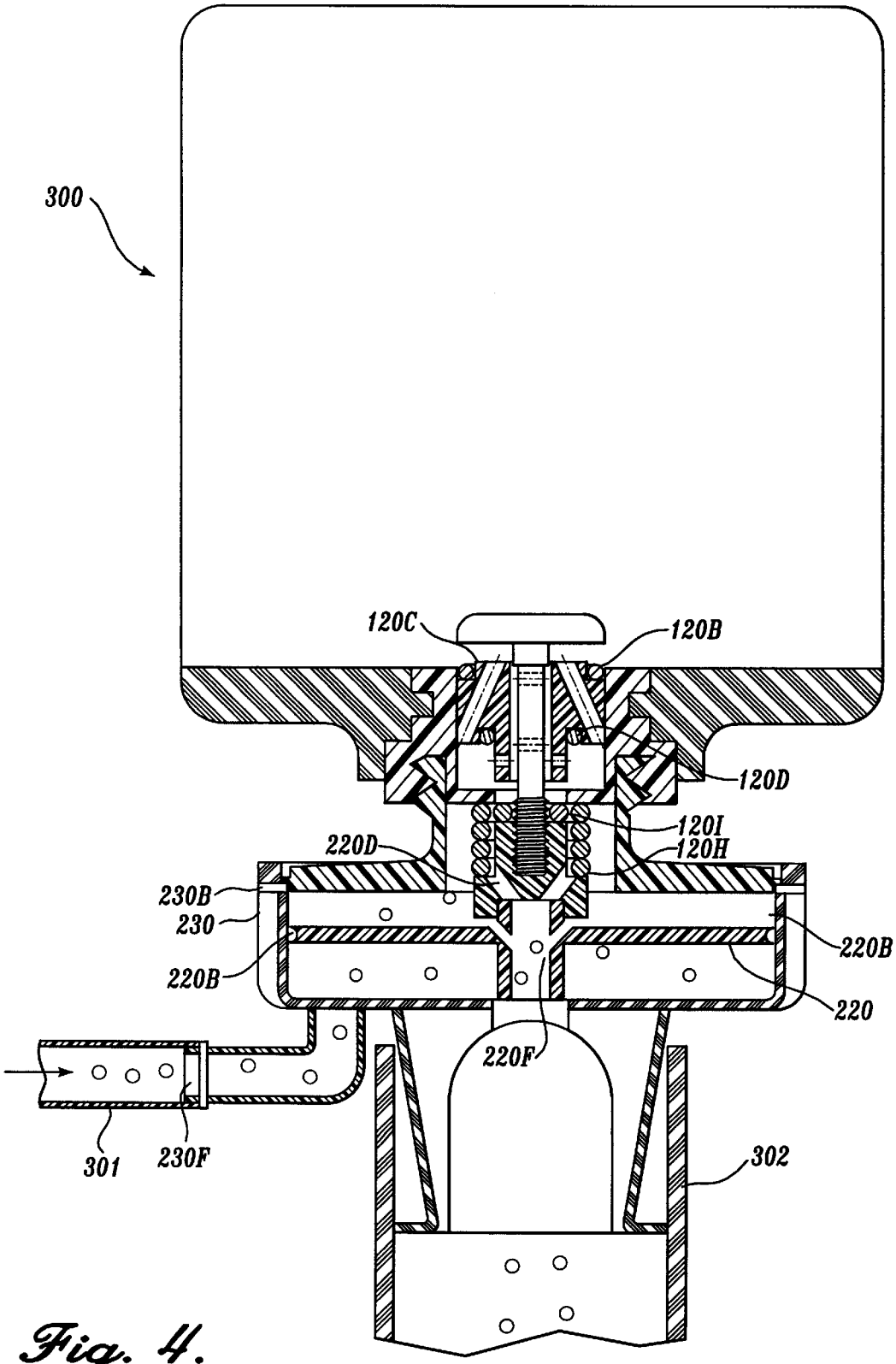
FIG. 4 is a cross-sectional diagram illustrative of an attachment dispenser with flexible container in filling the toilet tank and bowl and measuring chemical solution.

FIG. 4 is a cross-sectional diagram illustrative of an attachment dispenser system 300 with flexible container during a measuring operation. The measuring operation is performed to measure out a predetermined amount of chemical solution and refill the toilet tank and toilet bowl. This embodiment of the measuring operation is described below with reference to FIGS. 2–4.

The measuring operation is initiated when the toilet is flushed. As previously described, upon flushing, the existing level control valve unit provides pressurized water into a flexible hose 301, which has been attached to the angled hose connection 230*f*. The pressurized water moves the piston disk 220*b* upwards. The piston neck 220*a* of the hydraulic piston 220 is attached to the retainer 120*h* of the pumping unit 120. In particular, the piston neck 220*a* is press-fitted between the shoulders 120*t* of the retainer 120*h*. Thus, the upward movement of the hydraulic piston causes the valve structure 120*a* to also move upwards.

During a first stage or part of the measuring operation, only the valve structure 120*a* is extended, thereby uncovering the holes 120*n* in the plunger 120*c*. As a result, the holes 120*n* provide relatively large passages between the cavity 120*p* of the pump housing 120*f* and the storage unit 100*b*.

In a second stage of the measuring operation, the hydraulic piston 220 continues to move upwards in response to the pressurized water. Consequently, the retainer 120*h* is further moved toward the pump housing 120*e* (or 120*f*), eventually contacting the plunger 120*c*. The plunger 120*c* and the valve structure 120*a* are then both extended toward the storage unit 100*b*, thereby increasing the volume defined by the plunger 120*c* in the cavity 120*p*. This increase in the defined volume draws solution from the storage unit 100*b* into the cavity 120*p*. The relatively large holes 120*n* in the plunger 120*c* allow the seal between the plunger 120*c* and the inner surface of the pump housing 120*e* (or 120*f*) to be relatively loose (with a clearance of about 0.3 mm) with negligible leakage. Thus, no positive seal is needed. In addition, this clearance provides room for the chemical deposits on the plunger 120*c* and the inner surface of the pump housing 120*e* (or 120*f*) without affecting the movement of the plunger 120*c* within the pump housing. During this measuring operation, the holes 120*j* and 120*k* in the valve structure 120*a* are within the central longitudinal hole 120*m* of the plunger 120*c* (i.e., unexposed), preventing any flow of chemical solution out of the cavity 120*p* through the stem portion of the valve structure 120*a*. Further, with the 'O' ring 120*i* pressed firmly against the pump housing 120*e* at the bottom of the cavity 120*p*, the chemical solution is sealed in the cavity 120*p* during the measuring operation.

The pressurized water moving the hydraulic piston 220 also flows through the space between the piston disk 220*b* and the sidewalls of the base 230 and then into the pressure relief holes 220*d*. Consequently, the water flows through the central hole 220*f* and out the end of the piston stem 220*e* and into the overflow pipe 302 to refill the toilet bowl.

At the end of the measuring operation, the hydraulic piston is fully extended and the cavity 120*p* is substantially completely filled with chemical solution drawn from the storage unit 100*b*. The size of the cavity 120*p* is predetermined to hold a portion of the chemical solution to treat the toilet bowl water as desired. The chemical solution remains in the cavity 120*p* until the hydraulic actuator 200 initiates the injection operation.

Figure 5:
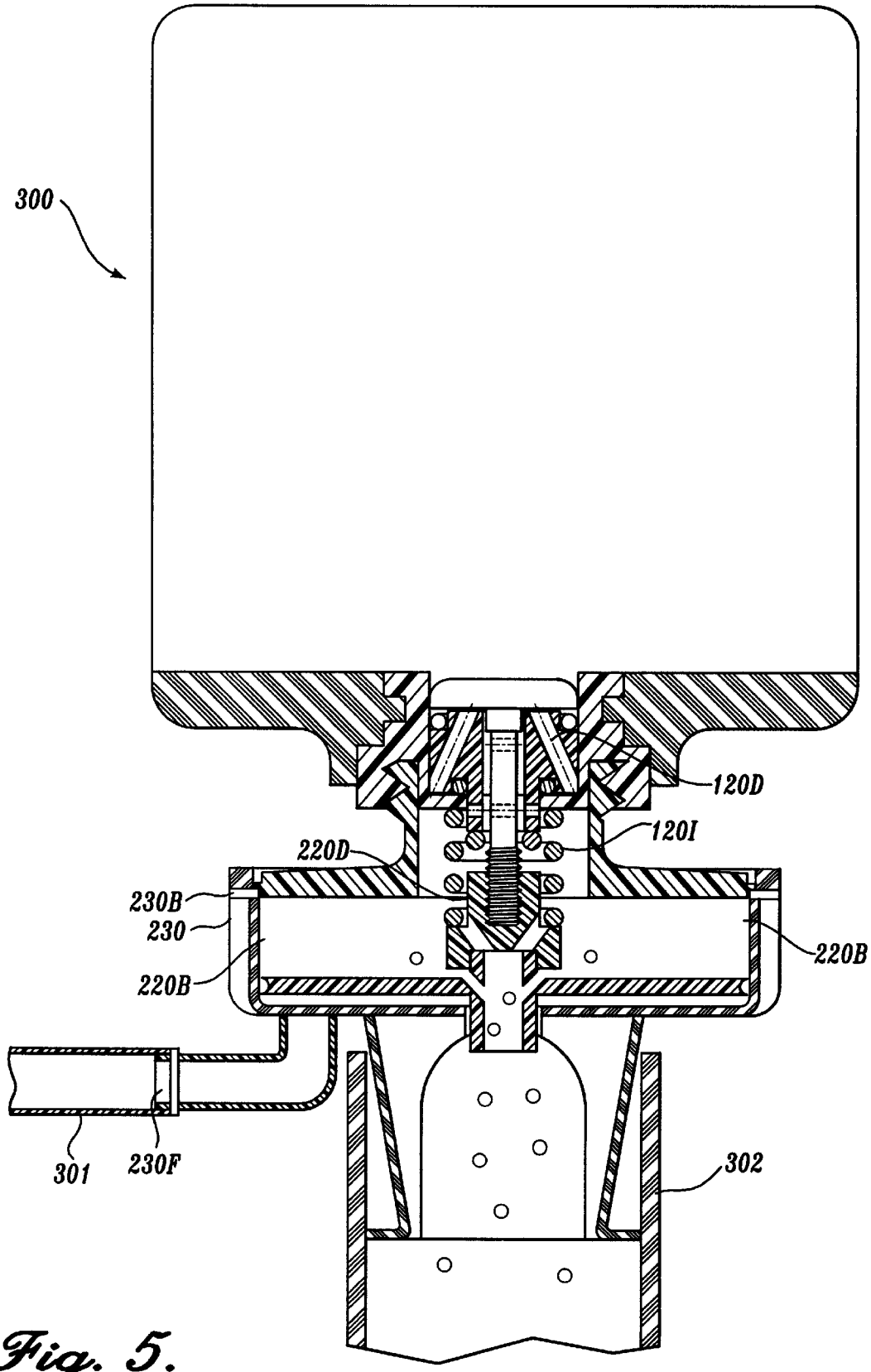
FIG. 5 is a cross-sectional diagram illustrative of the dispenser of FIG. 4 in injecting chemical solution into the toilet bowl.

FIG. 5 is a cross-sectional diagram illustrative of the automatic dispensing system 300 in injecting chemical solution into a toilet bowl.

After the toilet tank is refilled, the existing level control valve unit (not shown) shuts off the pressurized water in the flexible hose 301. Thus, the hydraulic force pushing the piston disk 220 upwards is terminated. As a result, the return spring 120*g* causes the valve structure 120*a* to move back to contact the top surface of the plunger 120*c*. As the valve structure 120*a* retracts to its initial position, the valve structure 120*a* covers the holes 120*n* in the plunger 120*c*, thereby preventing backflow of chemical solution into the storage unit 100*b*. At about the same time, the movement of the valve structure 120*a* exposes the holes 120*j* and 120*k* in the stem portion of the valve structure 120*a*. As previously described, the holes 120*j* and 120*k*, together with the hollow stem portion of the valve structure 120*a*, provide a passage between the cavity 120*p* and the retainer 120*h*. In addition, the holes 120*s* in the retainer 120*h* provide a further passage to the hollow piston neck 220*a* (and the hole 220*f*) of the hydraulic piston 220.

As the return spring 120*g* and the hydraulic actuator further cause the valve structure 120*a* to retract, the valve structure 120*a* contacts the top surface of the plunger 120*c*, causing the plunger 120*c* to move back to its initial position. This movement of the plunger 120*c* decreases the volume defined by the plunger 120*c* in the cavity 120*p*, forcing the chemical solution out of the cavity 120*p* through the hole 120*j* and out the hole 120*k*. In this embodiment, the chemical solution from the hole 120*k* is then forced through the holes 120*s* in the retainer 120*h*, and out into the overflow pipe 302 via the hole 220*f* in the hydraulic piston 220.

Because the injection operation is timed to start when the tank is refilled, the chemical solution is injected into the toilet bowl after the flushing process is essentially complete (i.e., no more of the toilet bowl water is being flushed away into the sewage system). Accordingly, this timed injection of the chemical solution avoids the flushing away of the newly injected chemical before the chemical can treat the toilet bowl. Instead the newly injected chemical remains in the toilet bowl until the next subsequent flush, allowing the chemical to treat the toilet bowl. Thus, the chemical solution is more efficiently used, thereby reducing the time and cost in using and maintaining the automatic dispensing system 300.

Figure 6:
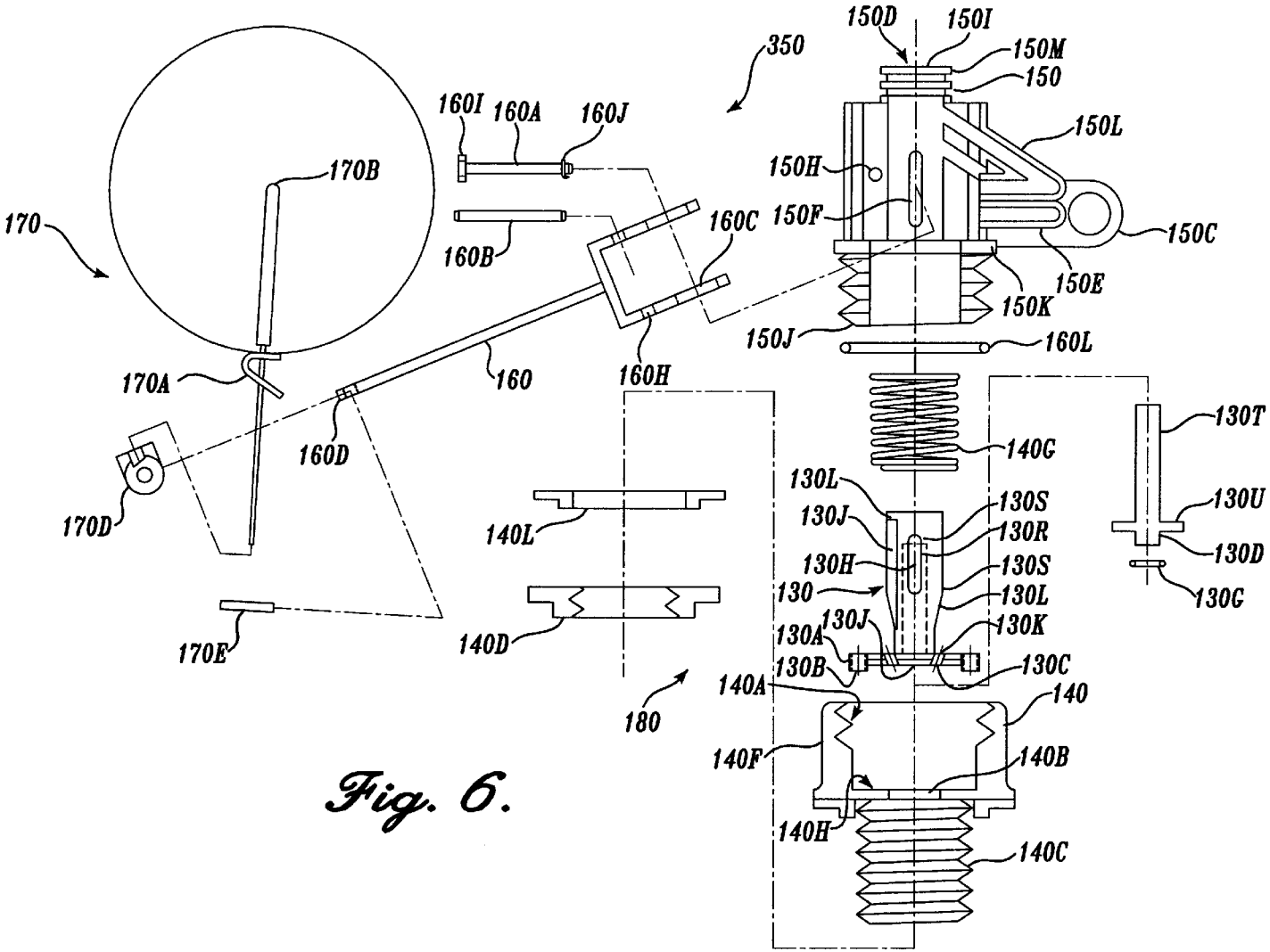
FIG. 6 is an exploded view diagram illustrative of integrated automatic dispensing system according to one embodiment of the present invention.

FIG. 6 is an exploded view diagram illustrative of integrated automatic dispensing system, according to one embodiment of the present invention. This embodiment of the integrated automatic dispensing system combines the function of a conventional level control valve unit and the automatic dispensing system 300 (FIGS. 4 and 5). The integrated system 350 includes a chemical dispenser (not shown) and a level control valve assembly 350. This embodiment is used as a replacement for an existing conventional level control unit in the toilet tank. The chemical dispenser is substantially similar to the pump unit 120 (FIG. 2) except that the retainer 120*f* is adapted to be fitted to the level control valve assembly. The level control assembly includes a buoy lever mechanism 170 and an integrated hydraulic actuator 180 with a dual piston assembly.

The dual piston assembly includes an outer hydraulic piston 130 and an inner hydraulic piston 130*f*. The outer hydraulic piston 130 includes a disk portion 130*a* with four flow control holes 130*b* and four pressure control holes 130*k*. The disk portion 130*a* is roughly 28 mm (diameter) ×4 mm (thick). The disk portion 130*a* is perpendicular to the longitudinal axis of a stem 130*s* of the outer hydraulic piston 130 and has a roughly 17 mm diameter circular recessed portion 130*c* on the surface opposite the stem 130*s*. The recessed is about 1 mm deep. The flow control holes 130*b* are about 2.5 mm in diameter and are evenly placed on a circle of about 20 mm diameter (i.e., on a 20 mm center), near the outer edge of the disk portion 130*a*. The pressure control holes 130*k* are roughly 2.5 mm and are located in the recessed area evenly placed on a 9 mm diameter circle from the center of the disk portion 130*a* (i.e., on a 9 mm center). The pressure control holes 130*k* are angled about thirty degrees from the center line of the stem portion of the outer piston 130. The outer piston 130 has a center hole 130*i* extending from the center of the disk portion 130*a* into the stem 130*s*. The hole 130*i* has a depth of about 30 mm and a diameter of about 6 mm.

The stem 130*s* of the outer piston 130 has a tapered portion 130*e* that starts approximately 16 mm from the top of the stem 130*s* and ends at about 13 mm from the disk portion 130*a*. The stem 130*s* also includes a retainer pin slot 130*h*, approximately 7 mm below the top of the stem 130*s*. The stem 130*s* also has a refill groove 130*j*. The refill groove runs longitudinally along the side of the stem 130*s* and is radially located about fifty degrees from the retainer pin slot 130*h*. The refill groove 130*j* starts approximately 3 mm from the top of the stem 130*s* and is about 2 mm (radius) ×23 mm (length) ×2.5 mm (depth). The stem 130*s* also has a chemical flush groove 1301. The chemical flush groove 1301 is located longitudinally on the side of the stem 130*s* and radially about fifty degrees from the retainer pin slot 130*h* (i.e., about one hundred degrees from the refill groove 130*j*). The chemical flush groove 1301 starts at the top of the stem 130 and approximately 10 mm (length) with the same dimensions as the refill groove 130*j*.

The dual piston assembly also includes an inner piston 130*f* that has a stem portion 130*t* that is slidably fitted in the center hole 130*i* of the outer piston 130. When fully inserted, a disk portion 130*u* of the inner piston 130*f* rests in the recess 130*c*. The inner piston 130*f* has a protrusion 130*d* upon which an 'O' ring 130*g* is optionally fitted. The protrusion 130*d* is about 7.5 mm (diameter) ×5 mm (length) and the 'O' ring 130*g* is about 11 mm (outer diameter) ×2 mm (thickness). The overall dimensions of the inner piston are roughly 16 mm (disk diameter) ×5.8 mm (stem diameter) ×35 mm (overall length).

The pistons 130 and 130*f* are fitted in a lower piston housing 140. The lower piston housing 140 has a roughly hollow cylindrical shape, with six vertical ribs 140*f* formed on the sides of the lower piston housing 140 and approximately flush with the top end of the lower piston housing 140. The lower piston housing is about 33 mm (outer diameter) ×28 mm (inner diameter) ×2 mm (rib depth) ×24 mm (rib length). The lower piston housing 140 has an internal thread 140*a* with a diameter of about 29 mm, extending about 10 mm into the lower piston housing 140 from the top end of the lower piston housing 140. The inner surface of the lower piston housing 140 between the thread and a bottom wall 140*h* is smooth. This smooth portion of the lower piston housing is roughly 28 mm (inner diameter) ×13 mm (length). The lower piston housing 140 also has an inlet hole 140*b* through the bottom wall 140*h*. The inlet hole 140*b* is about 8 mm (diameter) ×4 mm (depth). The lower piston housing 140 also has a threaded stem 140*c*, adapted to be attached to the existing toilet tank water inlet. A nut 140*d* is used to attach lower piston housing 140 to the toilet tank. The stem 140*c* is about 35 mm (length) ×22 mm (outer diameter) ×15.8 mm (inner diameter). An appropriate ring seal 140*e* is placed between the toilet tank and the nut 140*d* to help prevent water leakage.

The hydraulic actuator 180 also includes a roughly hollow cylindrical upper piston housing 150. A longitudinal hole 150*d* in the upper housing 150 is sized so that the stem 130*s* of the outer piston 130 can be slidably fitted into the longitudinal hole 150*d*. The upper piston housing 150 has parallel flattened sides 150*g* (only one side is visible, the other flattened side being hidden by the visible flattened side in FIG. 6). The flattened sides 150*g* are each about 19 mm (height) ×6.5 mm (width).

The bottom end of the upper piston housing 150 has external threading 150*a* that matches the internal thread 140*a* of the lower piston housing 140. This threaded portion is roughly 8 mm (length) ×28 mm (diameter). A balance spring 140*g* having a diameter slightly larger that the diameter of the longitudinal hole 150*d* is fitted onto the stem 130*s* of the outer piston 130. A piston 'O' ring 150*b* may be fitted at the threaded bottom end of the upper piston 150 abutting a flange 150*k*.

The upper piston housing 150 has a spring cavity 150*j* that is coaxial with the longitudinal hole 150*d*, having a diameter slightly larger than the diameter of the balance spring 140*g*. In this embodiment, the spring cavity 150*j* is about 19 mm (diameter) ×13 mm (length). The external threading 150*a* of the upper piston housing 150 is then screwed onto the internal threading 140*a* of the lower piston housing 140 to house the pistons 130 and 130*f* and compress the balance spring 140*g*. The piston 130 may be moved longitudinally within the now whole piston housing formed by the upper and lower pistons housings 150 and 140.

The upper piston housing 150 is also used to connect the dual piston assembly to a buoy mechanism 170 through a lever mechanism 160. The upper piston housing 150 has flattened sides, whereas the lever mechanism 160 is roughly "V-shaped" (only one arm of the "V-shape" is visible, the other arm being hidden by the visible arm in FIG. 6). The arms of the "V-shaped" lever mechanism 160 are spaced apart so that the upper piston housing 150 fits between the arms of the lever mechanism 160, with the flattened parallel sides 150*g* of the upper piston housing are adjacent to the inner surfaces of the arms of the lever mechanism 160.

One end of the lever mechanism 160 is attached to the upper housing using a fulcrum pin 160*a* slidably fitted through a slot 160*c* in both arms of the "V-shaped" lever mechanism 160, through the slot 130*h* in the outer piston stem 130*s*, and through slots 150*f* through the parallel flattened sides 150*g* of the upper piston housing 150. The fulcrum pin 160*a* is roughly 30 mm (length) ×3 mm (diameter). The slots 150*f* are roughly 3.5 mm (width) ×14 mm (length). The fulcrum pin 160*a* is inserted into the slots 160*c* and 150*f* so that the fulcrum pin 160*a* is above the stem 130*t* of the inner piston 130*f*. The fulcrum pin 160 is kept in the slots by a flange 160*i* on one end of the fulcrum pin 160 and a standard "E" clip 160*j* attached to the other end of the fulcrum pin 160.

The lever mechanism 160 is also connected to the upper piston housing 150 through a pivot pin 160*b* inserted through a hole 160*h* in both arms of the lever mechanism 160 and a pivot hole 150*h* in the upper piston housing 150. The pivot pin 160*b* may be held by the pivot hole 150*h* using frictional forces or, alternatively, through the use of a flange and "E" clip similar scheme as for described above for the fulcrum pin 160*a*. The center of the pivot hole 150*h* is located about 7 mm to 8 mm perpendicularly from the edge of the slot 150*f* and about 22 mm below the top of the upper piston housing 150. With the pivot pin 160*b* in place in the holes 160*h* and 150*h*, the lever mechanism 160, by pivoting about the pivot pin 160*b*, can move the stem 130*s* downwards within the longitudinal hole to the extent allowed by the slot 150*f*. When the lever mechanism does not provide a downward force on the stem 130*s*, the balance spring helps to move the outer piston 130 downwardly within the longitudinal hole 150*d*.

The upper end 150*i* of the upper piston housing has external threading 150*m* for connecting the storage unit 100*a* or 100*b* (FIG. 2) to the upper piston housing 150. When attached to the storage unit, the pumping unit 120 (FIG. 2) is held in place on top of the upper piston housing 150 so that the retainer 120*h* (FIG. 2) is in the hole 150*d*, with a gap between the bottom of the retainer 120*h* and the top of the stem 130*s* when the outer piston 130 is in a fully downward position. In particular, the lengths of outer piston 130 and the pumping unit 120 (FIG. 2) are such that the piston must close the gap before contacting the retainer 120*h* during the measuring operation.

The midsection of the upper piston housing 150 has three angled hose connections 150*c*, 150*e* and 1501. The connection 150*c* serves as a rim hose connection for use with rim flush type toilets. A plug (not shown may be used to prevent water flow through the connection 150*c* for toilets without the rim flush feature. In this embodiment, the connection 150*c* is located approximately 30 mm below the top surface of the upper piston housing 150 and is about 7.5 mm (internal diameter) ×9.5 mm (internal thread diameter) ×3.5 mm (optional plug inner hole diameter) in size.

The connection 150*e* serves as a bowl refill hose connection. Typically, a flexible hose similar to the hose 301 (FIG. 4) is connected between the connection 150*e* and the existing overflow pipe to fill the toilet bowl during the flush process. The connection 150*e* is located approximately 23 mm below the top of the upper piston housing 150, with a thirty-five degree downward angle. The opening of the connection 150*e* into the longitudinal hole 150*d* of the upper piston housing 150 is aligned vertically with the refill groove 130*j* in the stem 130*s* of the outer piston 130. The connection 150*e* is approximately 3 mm (inner diameter) ×90 degree (bend).

The connection 1501 serves as a chemical flush connection. The connection 1501 is located about 16mm below the top of the upper piston housing 150 with a thirty-five degree downward angle. The opening of the connection 1501 into the longitudinal hole 150*d* is aligned vertically with the outer piston flush groove 1301. The connection 1501 is approximately 3 mm (inner diameter) ×90 degree (bend).

Returning to the lever mechanism 160, a clip 170*a* attaches a buoy 170*b* to the end 160*d* of the lever mechanism. The overall length of the lever mechanism 160 is roughly 95 mm. The clip 170*a* is adjustable and fits over a rotatable pin 170*c*. In this embodiment, the clip 170*a* is 'C' shaped, and is about 3 mm (depth) ×8 mm (height) ×6 mm (width). The pin 170*c* is about 3 mm (diameter) ×8 mm (length). The buoy 170*b* is about 85 mm in diameter and typically provides about 0.5 to 0.7 pounds of buoyant force.

Figure 7:
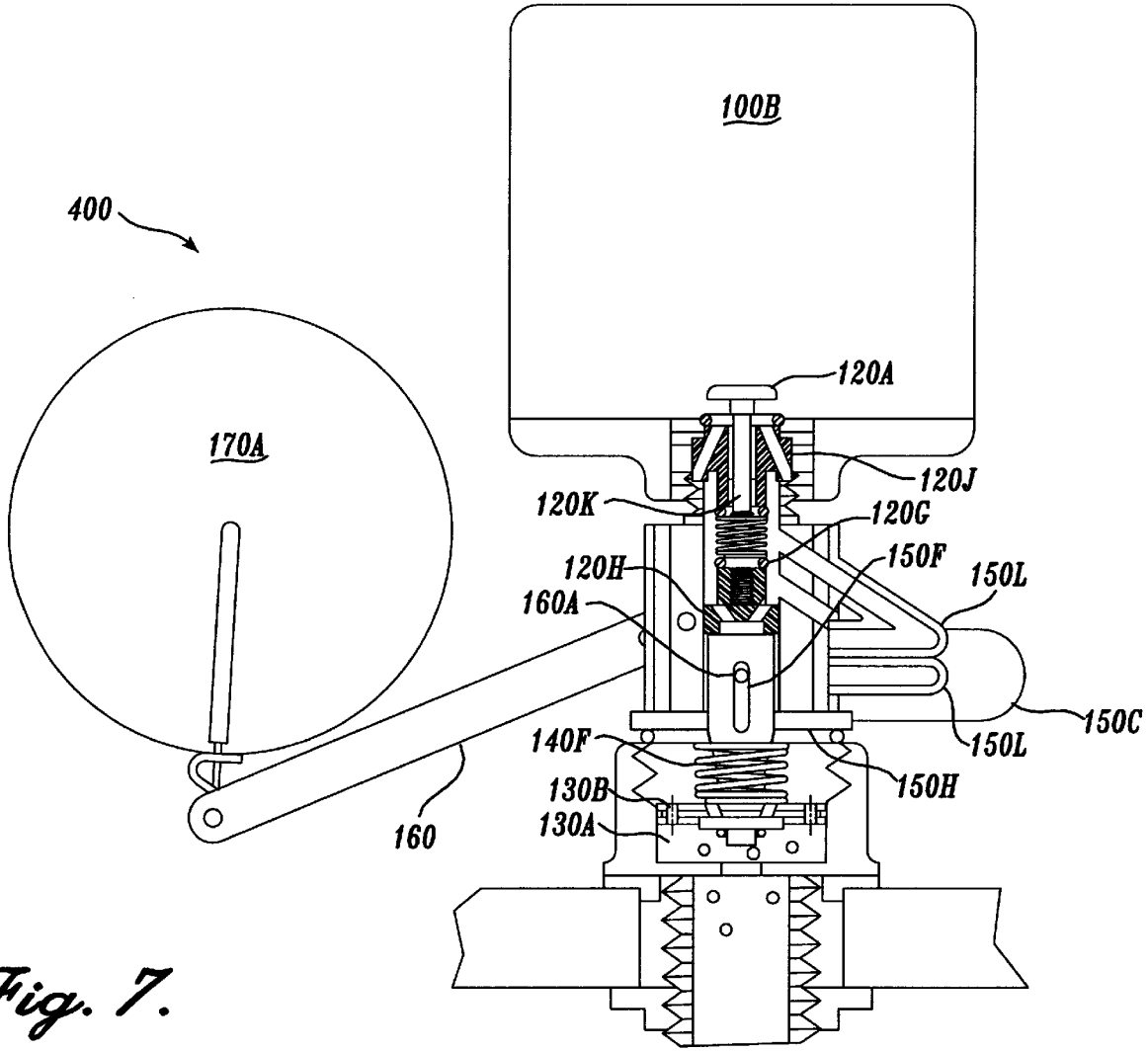
FIG. 7 is a cross-sectional diagram illustrative of an integrated dispenser with the flexible container in filling the toilet tank and bowl and measuring chemical solution.

FIG. 7 is a cross-sectional diagram illustrative of an integrated automatic dispenser system 400 with the flexible container in filling the toilet tank and bowl and measuring chemical solution. After the toilet is flushed, the water level in the toilet tank decreases. As a result, the buoy 170*a* drops, causing the lever mechanism 160 to pivot about the pivot pin 160*b*, thereby moving the pistons 130 and 130*f* upward. The upward movement of the piston 130*f* causes the protrusion 130*d* to uncover the inlet hole 140*b* in the lower piston housing 140, allowing pressurized water from the toilet tank's inlet pipe to enter the piston housing below the piston disk portions 130*a* and 130*u*. Some of the pressurized water flows through the flow control holes 130*b* in the outer piston 130, resulting in a pressure difference between the spaces separated by the disk portion 130*a*. The higher hydraulic pressure below the disk portion 130*a* pushes the pistons 130 and 130*f* upward and further helps to press the inner piston disk portion 130*u* against the outer piston disk portion 130*a*, thereby sealing the pressure control holes 130*k* in the outer piston disk portion 130*a*. The pressurized water that flows through the flow control holes 130*b* eventually flows out of the slots 150*f* to help fill the toilet tank. In addition, some of this pressurized water flows into the refill groove 130*j* in the stem 130*s* of the outer piston 130 and out of the refill connection 150*e* to help fill the toilet bowl via the overflow pipe.

As the piston 130 moves upward, the tapered portion 130*e* moves into the upper portion of the piston housing cavity, thereby increasing the volume of this upper portion. Consequently, the pressure is reduced in the upper portion of the piston housing cavity, resulting in a net increase of the upper hydraulic force on the pistons 130 and 130*f*.

Upward movement of the pistons 130 and 130*f* compresses the balance spring 140*g* and contacts the retainer 120*h* (FIG. 2) after traversing the aforementioned gap. Further upward movement pushes up the retainer 120*h*, causing the pumping unit (FIG. 2) to measure out a predetermined amount of chemical solution as previously described in conjunction with FIG. 2. Thus, the chemical dispenser measures out a precise amount of chemical solution to be injected into the toilet bowl.

While the pressurized water from the inlet hole 140*b* continues to flow into the piston housing, water continues to flow out through (a) the slots 150*f* to fill the toilet tank, (b) the connection 150*e* to the overflow pipe to fill the toilet tank, (c) the flush connection 1501 which also feeds the overflow pipe, and (d) the connection 150*c* to flush the toilet bowl when used with a rim flush type of toilet.

Figure 8:
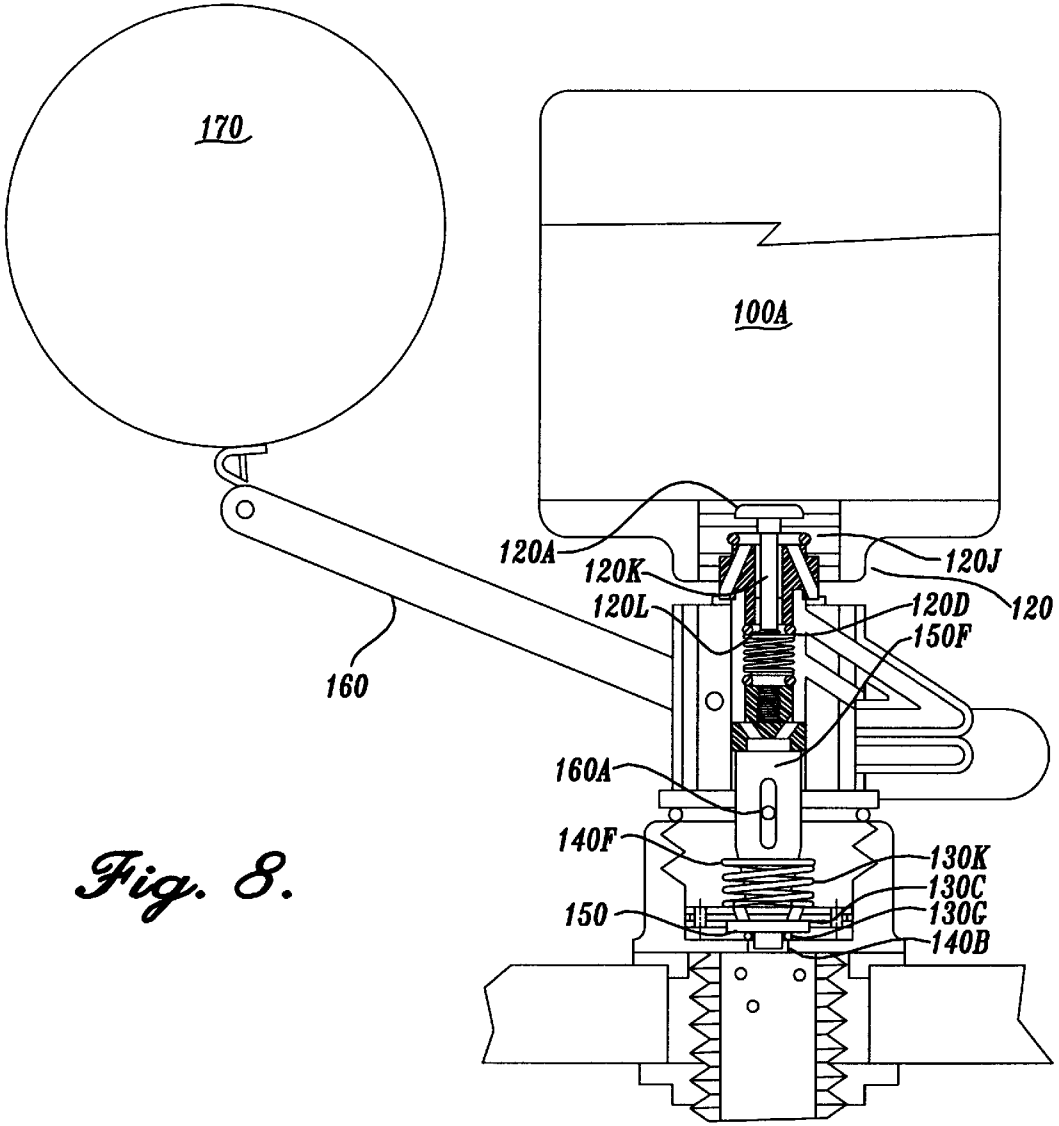
FIG. 8 is a cross-sectional diagram illustrative of the dispenser of FIG. 7 in injecting chemical solution into the toilet bowl and controlling the water level of the toilet tank.

FIG. 8 is a cross-sectional diagram illustrative of the integrated automatic dispenser system 400 in injecting chemical solution into the toilet bowl and controlling the water level of the toilet tank. After the toilet is flushed, the toilet tank is eventually refilled. As the water level in the toilet tank increases, the buoy 170*a* rises, causing a downward force to be applied to the inner piston 130*f* through the lever mechanism 160. This downward force eventually overcomes the hydraulic force keeping the inner piston 130*f* pressed against the outer piston 130, thereby exposing the pressure control holes 130*k* in the outer piston disk portion 130*a*.

With the pressure control holes 130*k* exposed, water can flow into the upper portion of the piston housing cavity, thereby reducing the pressure difference between the opposite sides of the disk portion 130*a* of the outer piston 130. The downward force provided by the buoy 170*a* through the lever mechanism 160, together with downward force provided by the balance spring 140*g*, moves the protrusion 130*d* of the inner piston 130*f* to cover the inlet hole 140*b*, thereby cutting off the flow of pressurized water from the toilet's existing inlet valve.

Because the flow of pressurized water is terminated, there is no longer any upward force on the pistons 130 and 130*f*. Thus, the upward force on the retainer of the pumping unit is also terminated. Consequently, the return spring 120*g* forces the plunger 120*c* to move downwards, outputting as previously described the measured amount of chemical solution. In this embodiment, the outputted chemical solution flows into the upper piston housing 150 and out the flush connection 1501, which communicates with the overflow pipe. As a result, the a precise amount of chemical solution is injected directly into the toilet bowl, timed so that the chemical solution is not provided until the current flushing process is completed.

The embodiments of the automatic dispensing system described above are illustrative of the principles of this invention and are not intended to limit the invention to the particular embodiments described. For example, other types of chemical solutions can be used, such as dyes or scents. In another example, different types of buoyancy and lever mechanisms can be implemented by those skilled in the art. Accordingly, while the preferred embodiment of the invention has been illustrated and described, it is appreciated that in light of the present disclosure various changes can be made to the described embodiments without departing from the spirit and scope of the invention.

What is claimed is:

1. A method for dispensing a chemical into a toilet bowl of a toilet, the toilet having an inlet valve to receive refill water, the method comprising:

opening a first valve communicating between a source of the chemical and a cavity using pressurized fluid when the toilet is flushed;

closing a second valve communicating between the chamber and the toilet bowl when the toilet is flushed;

measuring a predetermined amount of the chemical from the source after the first valve is opened and the second valve is closed;

closing the first valve when the toilet tank is filled;

opening the second valve when the toilet tank is filled; and ejecting the predetermined amount of chemical from the cavity into the toilet bowl with substantially none of the predetermined amount of the chemical entering the toilet tank.

2. The method of claim 1 further comprising using refill water from the toilet's inlet valve to operate an actuator to open the first valve and close the second valve when the toilet is flushed.

3. The method of claim 2 wherein the actuator comprises a hydraulic piston.

4. The method of claim 2 wherein the actuator applies a force to move a valve structure, the movement of the valve structure causing the first valve to open and the second valve to close.

5. The method of claim 4 wherein the flow of refill water is interrupted when the toilet tank is refilled, whereby the actuator discontinues applying the force on the valve structure.

6. The method of claim 5 wherein after the flow of refill water is interrupted, a spring provides a force to move the valve structure back to an initial position of the valve structure, the valve structure causing the first valve to close and the second valve to open.

7. The method of claim 1 wherein the chemical is in solution form.

8. An apparatus for automatically dispensing chemical into a toilet bowl of a toilet, the toilet having an inlet valve for receiving refill water, the apparatus comprising:

a chemical storage unit;

a pumping unit having a cavity, a first valve and a second valve, the first valve communicating between the chemical storage unit and the cavity, the second valve communicating between the cavity and the toilet bowl; and a hydraulic actuator coupled to the pumping unit, wherein the hydraulic actuator is configured to actuate the pumping unit to open the first valve and close the second valve using pressurized fluid when the toilet is flushed, and to remove a predetermined amount of chemical from the chemical storage unit after the first valve is opened and the second valve is closed.

9. The apparatus of claim 8 wherein the hydraulic actuator is further configured to initiate an injection operation in the pumping unit when the toilet bowl is substantially refilled after a flush, the pumping unit being configured to inject the predetermined amount of chemical into the toilet bowl during the injection operation.

10. The apparatus of claim 9 wherein the hydraulic actuator comprises a hydraulic piston coupled to receive refill water from the inlet valve during a flush, the hydraulic piston applying a force to move a valve structure in response to the receiving the refill water, the valve structure causing the first valve to open and the second valve to close.

11. The apparatus of claim 10 wherein the hydraulic actuator is further configured to terminate the force being applied to the valve structure when the injection operation is initiated.

12. The apparatus of claim 11 wherein during a first part of the injection operation, the pumping unit is configured to close the first valve and open the second valve.

13. The apparatus of claim 12 wherein the pumping unit is further configured to remove the chemical in the cavity during a second part of the injection operation.

14. The apparatus of claim 13 wherein the pumping unit comprises a spring coupled to the valve structure, wherein in response to the termination of the force applied by the hydraulic actuator, the spring moves the valve structure back to an initial position during the first part of the injection operation.

15. The apparatus of claim 14 wherein the pumping unit further comprises a plunger fitted in the cavity and coupled to the valve structure, wherein during the second part of the injection operation the spring causes the valve structure and the plunger to move in the cavity to move the chemical in the cavity through the second valve.

16. An apparatus for dispensing chemical into a toilet bowl of a toilet, the toilet having a toilet tank and an inlet valve for receiving refill water, the apparatus comprising:

a buoy;

a lever mechanism coupled to the buoy;

a chemical storage unit;

a pumping unit having a cavity, a first valve and a second valve, the first valve communicating between the chemical storage unit and the cavity, the second valve communicating between the cavity and the toilet bowl; and a hydraulic piston unit coupled to the pumping unit and the lever mechanism, wherein the hydraulic piston unit is configured to actuate the pumping unit to open the first valve and close the second valve when the toilet is flushed, and to remove a predetermined amount of chemical from the chemical storage unit after the first valve is opened and the second valve is closed.

17. The apparatus of claim 16 wherein the measuring operation is initiated when the buoy detects that the toilet tank is substantially emptied of water after the toilet has been flushed.

18. The apparatus of claim 17 wherein an injection operation is initiated when the buoy detects that the toilet tank is substantially refilled with water after the toilet was flushed, the pumping unit being configured to inject the predetermined amount of chemical into the toilet bowl during the injection operation.

19. The apparatus of claim 16 wherein the hydraulic piston unit comprises a first piston and a second piston, the second piston being fitted coaxially into a hole in the first piston.

20. The apparatus of claim 19 wherein the second piston is configured to open an inlet to receive a flow of refill water during the measuring operation and to close the inlet during the injection operation.

21. An apparatus for dispensing a chemical into a toilet receptacle of a toilet, the toilet having an inlet valve to receive pressurized water, a flow of pressurized water being directed into the toilet receptacle to flush the toilet with the flow being terminated when the flush is completed, the apparatus comprising:

a chemical storage unit, said chemical storage unit storing chemicals to treat the toilet receptacle;

a pumping unit having a cavity, a first chemical passage and a second chemical passage, the first chemical passage communicating between the chemical storage unit and the cavity, the second chemical passage communicating between the cavity and the toilet receptacle; and a hydraulic actuator coupled to the pumping unit, wherein the hydraulic actuator is configured to initiate a measuring operation when the toilet is flushed and to initiate an injection operation when the flush is complete, wherein during the measuring operation the hydraulic actuator is configured to:

actuate the pumping unit using pressurized water from the flow of pressurized water to open the first chemical passage and close the second chemical passage when the toilet is flushed, remove a predetermined amount of chemical from the chemical storage unit after the first part of the measuring operation, and wherein during the injection operation the hydraulic actuator is configured to:

close the first chemical passage and to open the second chemical passage, and inject the predetermined amount of chemical into the toilet receptacle.

22. The apparatus of claim 21 wherein the toilet is a urinal.

* * * * *